United States Patent [19]

Brown et al.

[11] 4,089,320

[45] May 16, 1978

[54] FIREPLACE FOR MOBILE HOME

[76] Inventors: Roy R. Brown, 2190 Plumas; Bernard A. Rilea, 16217 Pinon Rd., both of Reno, Nev. 89502

[21] Appl. No.: 676,812

[22] Filed: Apr. 14, 1976

[51] Int. Cl.[2] ..... F24B 1/18

[52] U.S. Cl. ..... 126/121

[58] Field of Search ..... 126/121, 122, 63, 66; 237/51

[56] References Cited

U.S. PATENT DOCUMENTS

| | | | |
|---|---|---|---|
| 1,526,679 | 2/1925 | Johnson | 126/121 |
| 2,231,258 | 2/1941 | Elmore | 126/121 X |
| 2,258,882 | 10/1941 | Craig | 126/121 |
| 2,429,748 | 10/1947 | Dollinger | 126/121 |
| 3,180,332 | 4/1965 | Grushkin | 126/121 |
| 3,533,394 | 10/1970 | Rose et al. | 126/121 |
| 4,010,728 | 3/1977 | Hempel et al. | 126/121 |

FOREIGN PATENT DOCUMENTS

| | | | |
|---|---|---|---|
| 341,367 | 10/1904 | France | 126/121 |

*Primary Examiner*—William F. O'Dea
*Assistant Examiner*—Harold Joyce
*Attorney, Agent, or Firm*—Clarence A. O'Brien; Harvey B. Jacobson

[57] ABSTRACT

A fireplace construction is provided including a hollow base and a firebox having interconnected opposite side, rear and bottom walls is mounted on the base and includes an open front side. Closed heating air plenum structures are disposed outwardly of the firebox including interconnected opposite side, rear and top wall portions and a front wall portion extending between and interconnecting the forward marginal edge portions of the side and top wall portions and provided with an opening through which the front side of the firebox opens. The base includes upstanding peripheral walls and one of the walls has heated air outlet openings formed therein. The lower portions of the heating air plenum structures open into the base and combustion air plenum structure extends peripherally about the open side of the firebox and opens into the latter through openings spaced along the forward marginal edges of at least two of the walls of the firebox. The combustion air plenum structure includes air inlet structure and room air plenum structure is disposed above the heating air plenum structure and includes air inlet openings therefor. Air pump structure is disposed within the room air plenum structure and has an inlet in the room air plenum structure and an outlet opening into the heating air plenum structures.

4 Claims, 5 Drawing Figures

FIREPLACE FOR MOBILE HOME

BACKGROUND OF THE INVENTION

Various forms of fireplaces have been designed for installation in an existing structure. However, most of these previously designed fireplaces have not been suitable for use in mobile homes and constructed in a manner whereby they may be marketed in a packaged manner and erected within a mobile home by relatively unskilled workmen. Further, previously designed fireplaces marketed for use in existing structures are usually of heavy construction and may not be mounted against a wall of that structure.

Examples of previously known fireplaces including some of the basic structure of the instant invention are disclosed in U.S. Pat. Nos. 1,681,449, 1,681,995, 1,697,635, 2,039,492, 3,533,394 and 3,654,913.

BRIEF DESCRIPTION OF THE INVENTION

The fireplace of the instant invention is constructed in a manner whereby air to be heated within an associated mobile home is pumped through the fireplace in contact with heated internal surfaces thereof and thereafter discharged back into the mobile home. Further, the fireplace is constructed in a manner whereby it may use exterior air for combustion purposes or interior air for combustion purposes and if interior air is to be used for combustion purposes, it is bled off from the interior air being pumped through the fireplace for heating purposes.

The fireplace is constructed in a manner whereby it may be marketed in prepackaged form and readily erected by semi-skilled labor within a mobile home. Further, the fireplace construction enables it to be mounted directly against a wall of the associted mobile home and includes a glass door mullion assembly whereby the possibility of sparks from within the fireplace being projected outwardly through the front opening thereof may be eliminated.

The main object of this invention is to provide a fireplace for use in mobile homes.

Another object of this invention is to provide a fireplace which may be marketed in prepackaged form and erected by semi-skilled labor.

Another object of this invention is to provide a fireplace specifically designed to burn wood logs within a mobile home and yet which may be used to burn other fuel.

Still another object of this invention is to provide a fireplace including means whereby interior air is pumped through the fireplace in good heat transfer relation with internal heated surfaces thereof and then discharged back into the room in which the fireplace is disposed.

Another object of this invention is to provide a fireplace including forced combustion air inlet structure operative to bleed off a portion of the room air being pumped through the fireplace for heating purposes and for that portion of air to be utilized as combustion air.

A final object of this invention to be specifically enumerated herein is to provide a fireplace construction in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates a mobile home or the like including adjacent walls 12 and 14 interconnected by means of ceiling and floor structures 16 and 18.

Figure 1:
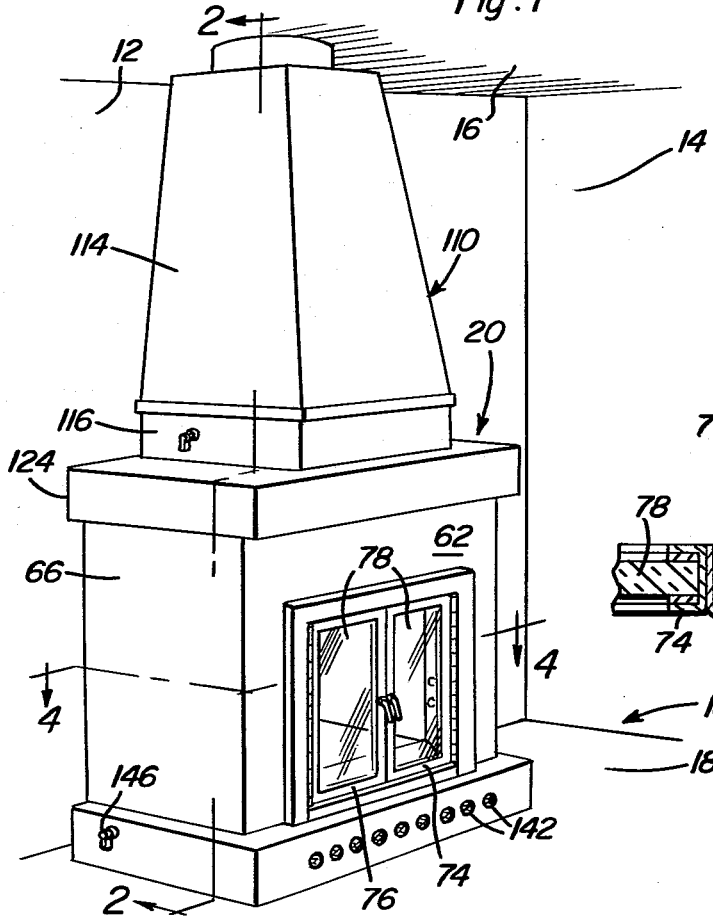
FIG. 1 is a perspective view of the fireplace of the instant invention.
Figure 5:
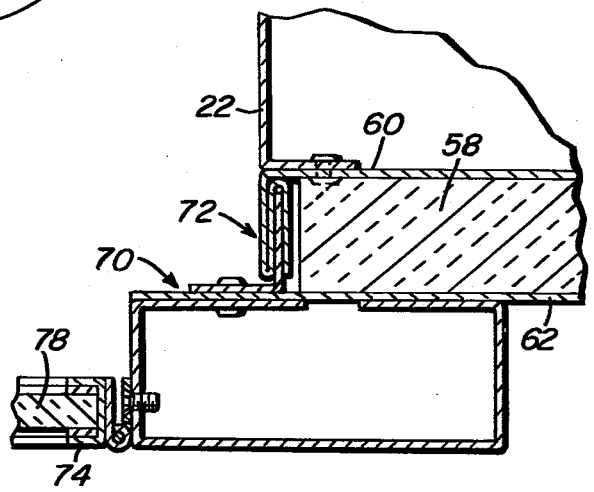
FIG. 5 is an enlarged, fragmentary, horizontal, sectional view illustrating the expansion joint by which the glass door mullion of the fireplace is supported from the remainder thereof.

The numeral 20 generally designates the fireplace of the instant invention and it may be seen from FIG. 1 that the fireplace 20 is supported from the flooring structure 18 against the wall 12.

Figure 4:
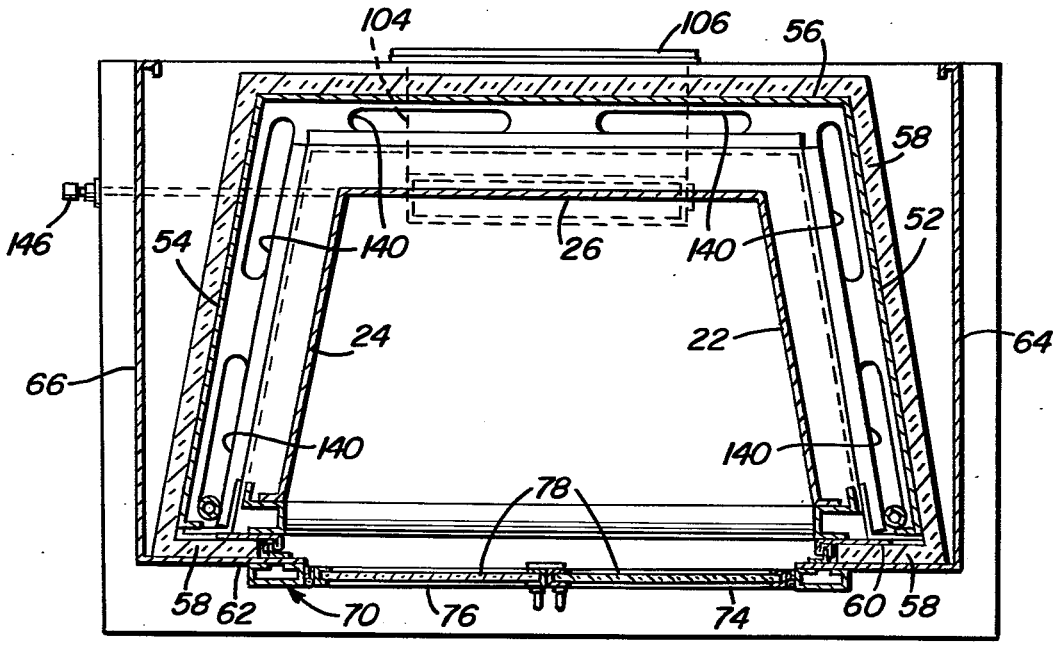
FIG. 4 is an enlarged, horizontal, sectional view taken substantially upon the plane indicated by the section line 4—4 of FIG. 1.
Figure 3:
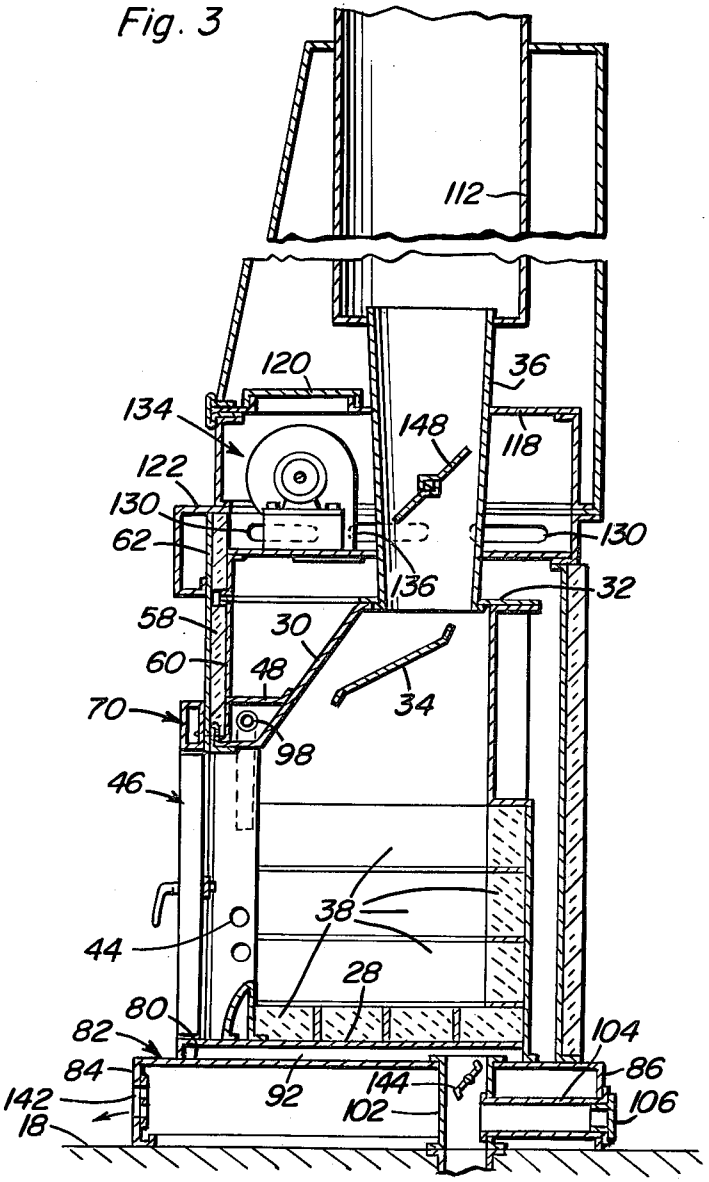
FIG. 3 is a vertical, sectional view taken substantially upon a plane passing through the center of the fireplace illustrated in FIG. 2.
Figure 2:
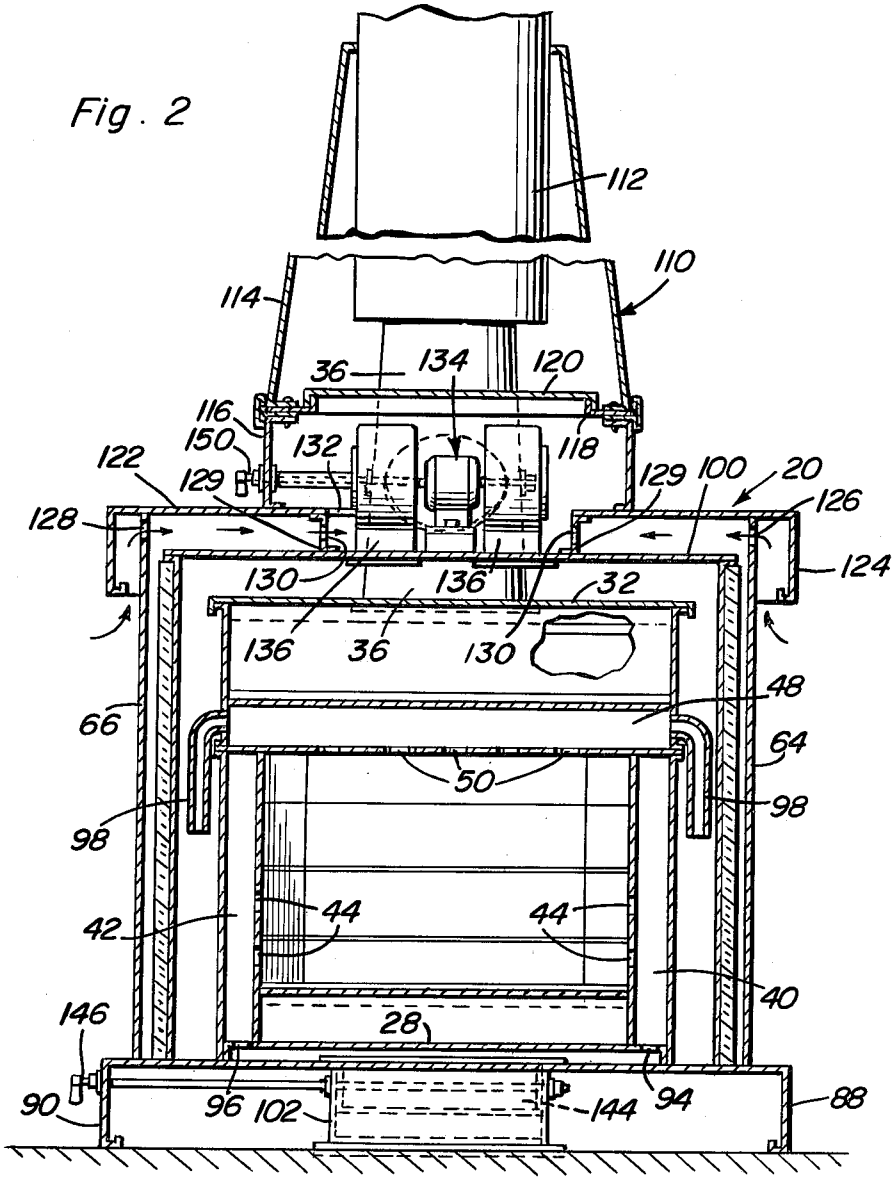
FIG. 2 is an enlarged, fragmentary, vertical sectional view taken substantially upon the plane indicated by the section line 2—2 of FIG. 1.

With reference now more specifically to FIGS. 2, 3 and 4 of the drawings, it may be seen that the fireplace 20 includes a firebox having upstanding opposite side walls 22 and 24 and a rear wall 26 interconneced by means of a bottom wall 28. The firebox additionally includes a rearwardly and upwardly inclined upper front wall 30 and a top wall 32 joining the upper marginal portions of the side walls 22 and 24, the rear wall 26 and the partial top wall 32. A forwardly and downwardly inclined radiation shield 34 supported between the upper portions of the side walls 22 and 24 extends across the upper portion of the interior of the firebox immediately below the lower end of a flue pipe 36 which opens downwardly through the top wall 32.

The internal surfaces of the lower portions of the walls 22, 24 and 26 and the inner surface of the bottom wall 28 are lined with fire brick 38 and hollow tubular combustion air plenums 40 and 42 are disposed outwardly of and extend vertically along the forward marginal portions of the walls 22 and 24 and include outlet openings 44 spaced therealong which open into the open front side of the firebox inwardly of the double door structure referred to in general by the reference numeral 46 to be hereinafter more fully set forth. In addition, a third combustion air plenum 48 extends along the outer side of the lower marginal portion of the inclined wall 30 and includes openings 50 spaced therealong which open downwardly into the interior of the firebox also inwardly of the double door structure 46.

A heating air plenum is defined outwardly of the firebox by means of upstanding opposite side walls 52 and 54 interconnected along their rear marginal portions by a rear wall 56. The outer surfaces of the walls 52, 54 and 56 are covered with insulative material 58 and an inner front panel structure 60 extending upwardly along both sides of the forward portion of the firebox and across the front of the fireplace 20 above the open side of the firebox interconnects the forward marginal edges of the walls of the firebox and the heating air plenum defined by the walls 52, 54 and 56, the structure 60 also being provided with insulation material 58.

The fireplace 20 includes an outer front wall 62 and outer opposite side walls 64 and 66 between which the front wall 62 extends and a mullion structure referred to in general by the reference numeral 70 is supported from the front wall 62 and the structure 60 by means of an expansion joint assembly referred to in general by the reference numeral 72. The double door structure 46 includes a pair of horizontally swingable door frames 74 and 76 hingedly supported from the mullion structure 70 by any convenient means and provided with glass panels 78 whereby the front of the firebox may be substantially fully closed.

All of the hereinbefore set forth structure is supported from the top wall 80 of a hollow base referred to in general by the reference numeral 82. The base 80 includes a front wall 84, a rear wall 86 and opposite side walls 88 and 90 which are interconnected by means of the top wall 80. The bottom wall 28 is spaced slightly above the top wall 80 in order to define a combustion air passage 92 for exterior air and the lower ends of the combustion air plenums 40 and 42 open down into the combustion air passage 92 through openings 94 and 96 formed in those opposite side marginal portions of the bottom wall 28 disposed exteriorly of the walls 22 and 24 of the firebox.

The opposite ends of the combustion air plenum 48 include downwardly directed smoke traps 98 opening downwardly into the heating air plenum defined between the external surfaces of the firebox and the internal surfaces of the walls 52, 54 and 56 and the upper ends of the latter are closed by means of a horizontal wall 100 extending therebetween. Accordingly, combustion air for the combustion air plenum 48 is provided from the heating air plenum defined between the external surfaces of the firebox and the walls 52, 54 and 56 and the combustion air for the combustion air plenums 40 and 42 is provided from the combustion air passage 92. An upstanding tubular fitting 102 is secured through the base 82 and opens into the combustion air passage 92. The lower end of the fitting 102 extends downwardly through the floor structure 18 and the fitting 102 includes a horizontal branch 104 which extends through the rear wall 86 of the base 82 and may be capped as at 106 or communicated with air exteriorly of the mobile home 10 by means of an air passage formed through the wall 12.

A hollow enclosure referred to in general by the reference numeral 110 incloses the upper and of the flue pipe 36 which opens into the lower end of an upstanding chimney pipe 112 and the enclosure 110 includes an upper section 114 enclosing the lower end of the chimney pipe 112 and a lower section 116 enclosing the intermediate portion of the flue pipe 36, the sections 114 and 116 being separated by a horizontal partition 118 including a removable access panel 120. In addition, the fireplace 20 includes an outer top wall 122 which extends between and interconnects the upper ends of the walls 62, 64 and 66. The top wall 122 projects outwardly of the walls 62, 64 and 66 and includes a down turned skirt 124 extending about and spaced outwardly of the walls 62, 64 and 66. The upper ends of the walls 64 and 66 have heating air openings 126 and 128 formed therein and front to rear extending opposite side braces 129 having openings 130 formed therein extend between the top wall 100 and the opposite side marginal edges of a central opening 132 formed in the top wall 122. An electric motor-driven double fan assembly referred to in generaly by the reference numeral 134 is disposed within the lower section 116 and includes air outlets 136 opening downwardly through the top wall 100 and into the heating air plenum defined between the walls 52, 54 and 56 and closed at its top by means of the wall 100. Accordingly, air from within the mobile home 10 is drawn upwardly beneath the skirt 124, through the openings 126 and 130 and is thereafter pumped downwardly into the heating air plenum by means of the electric motor-driven assembly 134. This air passes in intimate contact with the heated outer surfaces of the firebox disposed within the heating air plenum and thereafter passes downwardly through openings 140 formed in those portions of the top wall 80 of the base 82 at the bottom of the opposite side and rear portions of the heating air plenum. Accordingly, the heated air passes into the hollow base 82 and passes outwardly through air outlet openings 142 formed in the front wall 84 of the base. However, whenever the motorized assembly 134 is in operation, a portion of the air pumped into the heating air plenum will pass upwardly through the depending smoke traps 98 and into the combustion air plenum 48 for discharging therefrom through the openings 50 into the upper forward portion of the interior of the firebox. The fixture 102 is provided with a rotatable damper 144 operable by means of a control rod 146 extending outwardly through the side wall 90 of the base 82 and the flue pipe 36 includes a rotatable damper 148 operable by means of a control rod 150 projecting outwardly through the left side of the lower section 116 of the enclosure 110.

Inasmuch as the forward marginal portions of the side walls 22 and 24 are separated from the mullion assembly 70 by means of the combustion air plenums 40 and the heated exterior surfaces of the firebox are completely enclosed within the insulated heating air plenum defined by the walls 52, 54 and 56, the outer surfaces of the walls 62, 64 and 66 cannot be heated to any appreciable extent by the fire within the firebox. Further, the top wall 22 is, of course, also supported in a double insulated manner from the firebox by means of a double passage of heating air between the top wall 122 and the top wall 32 and the enclosure 110 is at least insulated, to some degree, from the flue pipe 36. Of course, the lower and intermediate portions of the flue pipe 36 are cooled by heating air being pumped through the fireplace and therefore little heat is transferred from the upper portion of the flue pipe 36 to the enclosure 110.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A fireplace construction including a hollow base, a firebox including interconnected opposite side, rear and bottom wall means mounted on and overlying said base and including an open front side, closed, hollow and vertically extending heating air plenum means disposed outwardly of said firebox including interconnected opposite side, rear and top wall portions and a front wall portion extending between and interconnecting the forward marginal edge portions of said side and top wall portions, said heating air plenum means enclosing said firebox therewithin, said front wall portion being provided with an opening through which the front side of said firebox opens, said base including upstanding peripheral walls, one of said upstanding walls having heated air outlet openings formed therein, the lower portion of said heating air plenum means opening into said base, closed, hollow combustion air plenum means within the confines of said heating air plenum means exteriorly of said firebox and extending peripherally about said open front side of said firebox and opening into the latter through openings spaced along the forward marginal edges of at least two of the walls of said firebox, said combustion air plenum means including air inlet means, and room air plenum means disposed above said heating air plenum means and including air inlet means therefor, air outlet means opening into an upper portion of said heating air plenum means and electric motor driver air pump means for pumping ambient room air through said room air plenum means into said heating air plenum means, said combustion air plenum means including a portion isolated from the remainder of said combustion air plenum means including outlet means opening into said fireplace and restricted inlet means opening into said heating air plenum means downstream from said air pump means.

2. The combination of claim 1 wherein said air inlet means for said combustion air plenum means opens downwardly through said base out of communication with the interior of said base.

3. The combination of claim 1 wherein said restricted air inlet means for said combustion air plenum means includes an inlet pipe discharging into said firebox and including an inlet portion extending and opening downwardly into said heating air plenum means.

4. The combination of claim 1 including openable transparent door means closing the open front side of said firebox.

* * * * *